US005482283A

United States Patent [19]

Wall

[11] Patent Number: 5,482,283

[45] Date of Patent: Jan. 9, 1996

[54] GOLF CLUB

[76] Inventor: David A. Wall, 9512 Tanoan Dr. N.E., Albuquerque, N.M. 87111

[21] Appl. No.: 436,749

[22] Filed: May 8, 1995

[51] Int. Cl.[6] ..... A63B 69/36

[52] U.S. Cl. ..... 273/186.3; 273/187.6

[58] Field of Search ..... 273/186.3, 186.2, 273/187.4, 187.5, 187.6, 194 R, 194 A, 194 B

[56] References Cited

U.S. PATENT DOCUMENTS

| | | | |
|---|---|---|---|
| 5,029,868 | 7/1991 | Cloud | 273/186.3 X |
| 5,082,282 | 1/1992 | Hernberg | 273/186.3 |
| 5,165,691 | 11/1992 | Cook | 273/186.3 |
| 5,169,150 | 12/1992 | Tindale | 273/186.3 |
| 5,217,228 | 6/1993 | Aguilar | 273/186.3 |
| 5,374,063 | 12/1994 | Ogden | 273/186.3 |

*Primary Examiner*—George J. Marlo
*Attorney, Agent, or Firm*—Rodger H. Flagg

[57] ABSTRACT

A golf club having a shaft, a head secured to one end of the shaft and a grip handle secured to the other end of the shaft. A light generator and an energy source positioned in operative connection to generate a plurality of light beams emanating from the club head hitting surface on opposite sides of a centrally located "sweet spot," respectively. The light beams converging toward and intersecting an imaginary line extending from the "sweet spot" generally perpendicularly to the surface and through the center of the golf ball to be hit by the club.

18 Claims, 4 Drawing Sheets

GOLF CLUB

BACKGROUND OF THE INVENTION

This invention relates to improved golf clubs, and more particularly, to an improved golf club which includes a light generator for generating light beams outwardly from the striking surface of the club to convey to the user information with regard to the proper trajectory of the swing. The invention relates particularly to putters and to control of the proper attitude of the putter face relative to the ball surface during the back swing, at impact, and during follow-through. When applied to other clubs, the concepts of the invention may extend to other aspects of the golf swing, such as the force of the swing to accomplish the golf shot desired.

Golf clubs of a variety of designs have been heretofore proposed. U.S. Pat. No. 5,165,691 issuing to Jon C. Cook on Nov. 24, 1992, discloses a laser golf club putter assembly having singular or parallel beams. U.S. Pat. No. 5,082,282 issuing to Joseph Hernberg on Jan. 21, 1992 discloses a dual light source golf swing trainer. U.S. Pat. No. 5,217,228 issuing to Juan De Agullar on Jun. 8, 1993 discloses a golf club light beam orienting device. U.S. Pat. No. 5,169,150 issuing to John Tindale on Dec. 8, 1992 discloses a putting stroke correcting device.

However, most golf club designs do not include any device to improve one's golf swing or to measure the force of the swing. It is well known that the successful strike of a ball by a golf club is dependent solely upon the alignment or orientation of the club head at the point of contact with the ball. If the hitting surface at the point of contact is anything but perfectly square or normal to the target line, then the ball will not travel to the intended target. The distance the ball will travel is well known to be dependent solely upon the force that the golf club strikes the ball. Furthermore, it is generally accepted that the impact surface of the club head should remain square, or normal, to the target line during both the back swing and the forward swing of the club.

In order to maintain the impact surface square to the target line, it is necessary to rotate one's hands in and anti-clockwise direction (for a right-handed person) in the back swing, and then to rotate the hands in a clockwise direction during the forward swing such that the club head arrives at the square position at the point of impact, and then to continue rotating one's hands in a clockwise direction during the follow-through so as to again maintain the club head in a square position.

Such movement of the club head during the back swing and the forward swing and the follow-through is extremely difficult to achieve, and thus, it is highly desirable to provide an improved golf club having means thereon which allows the golfer to visually see errors in the swing and to correct the same.

It is also highly desirable to provide an improved golf club in which the trajectory of the golf swing may be aligned and measured and any errors indicated to the golfer such that the golfer may make corrections in the swing and ultimately arrive at, or perfect, the desired golf shot.

As the golfer is viewing the club head from some distance, and given that the point of observation does not change and the club head moves back and forth through the golf swing, the perspective is such that it its extremely difficult to gauge the position of the club head with respect to the target line. In the past, devices have been proposed which indicate the orientation of the club head with respect to the target. These devices include light sources that direct a beam of light which is parallel to the intended target line. Such will indicate a position to which the club head is being aimed provided there is a surface onto which the light beam may project. However, such devices are not convenient to allow a person to readily ascertain the orientation of the club head impact surface during the back swing through the follow-through.

The foregoing criteria are particularly applicable to the use of putters. Thus, maintaining the striking face of the putter square to the target line, especially at impact, is extremely important. Any improvement which would allow a golfer to keep such a square position during the backward and forward movements of putting would virtually guarantee a proper attitude of the putter face at impact and would be of great benefit to golfers.

It is also highly desirable to provide an improved golf club which enables the golfer to be confident of the initial aim at the target and the execution of the swing during play. Enhanced practice can achieve that goal.

Club alignment is not easily visualized. Thus, it is highly desirable to provide an improved golf club having means by which club alignment can be better visualized by the golfer.

It is also highly desirable to provide an improved golf club having all of the above desired features.

SUMMARY OF THE INVENTION

It is therefore an object of the invention to provide an improved golf club having means thereon which allows the golfer to visually see errors in the swing and to correct the same.

It is also an object of the invention to provide an improved golf club in which the trajectory of the golf swing may be aligned and measured and any errors indicated to the golfer such that the golfer may make corrections in the swing and ultimately arrive at, or perfect, the desired golf shot.

It is also an object of the invention to provide an improved golf club which enables the golfer to be confident of the initial aim at the target and the execution of the swing during play.

It is also an object of the invention to provide a putter for a golfer which will achieve the foregoing benefits.

It is also an object of the invention to provide an improved golf club having means by which club alignment can be better visualized by the golfer.

It is also an object of the invention to provide an improved golf club having all of the above desired features.

In the broader aspects of the invention, there is provided a golf club having a shaft, a head secured to one end of the shaft, and a grip handle secured to the other end of the shaft. A light generator and an energy source is positioned in operative connection to generate at least one light beam emanating from the striking face of the club at a position so that the beam is directed onto the center of a golf ball when the golf club is positioned behind the ball. This arrangement permits the golfer, particularly when putting in a proper fashion, to maintain the beam on the ball during the backward and forward stroke thereby insuring that the face of the club is in a position square to the target when the club face strikes the ball. In one form of the invention, a plurality of light beams emanate from the club head hitting surface on opposite sides of a centrally located "sweet spot," respectively. The light beams converge toward and intersect an imaginary line extending from the sweet spot generally perpendicularly to the surface and through the center of the golf ball to be hit by the club.

BRIEF DESCRIPTION OF THE DRAWINGS

The above-mentioned and other features and objects of the invention and the manner of attaining them will become more apparent and the invention itself will be better understood by reference to the following description of embodiments of the invention taken in conjunction with the accompanying drawings wherein.

DETAILED DESCRIPTION OF THE SPECIFIC EMBODIMENTS

Figures 1, 3:
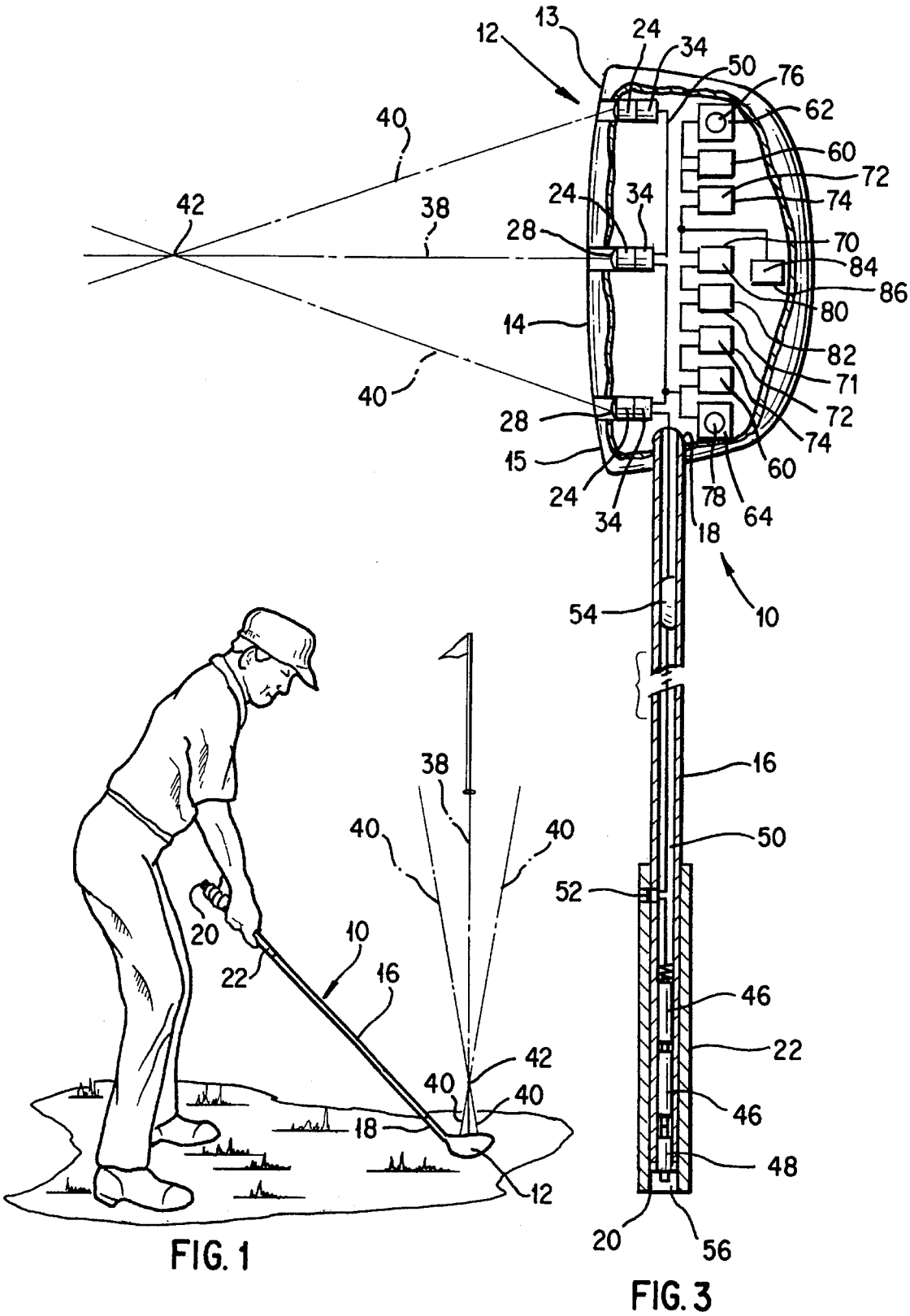
FIG. 1 is a perspective view showing a golfer holding the improved golf club of the invention and utilizing the improved alignment features thereof.
FIG. 3 is a sectional view of the golf club of the invention showing the components of the club utalizing three light generators.

Referring now to the drawings wherein like reference numerals refer to like parts, there is shown the improved golf club 10 of the invention. Golf club 10 includes a head 12 having a striking surface or club face 14 and a shaft 16. Shaft 16 is secured to the head 12 in the conventional manner at one end 18 thereof and has a grip handle 22 secured to the opposite shaft end 20, again, in a conventional manner.

Figure 5:
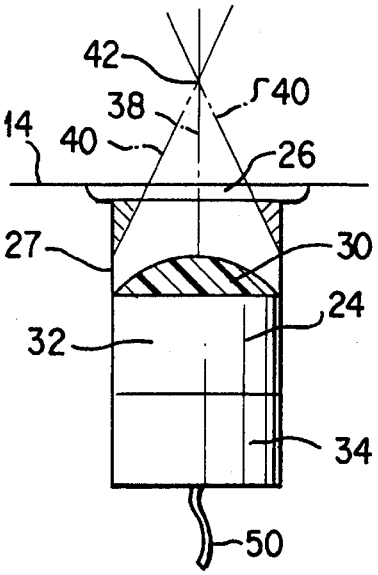
FIG. 5 is a diagrammatic cross-sectional view of the invention utalizing a single light generator to produce three light beams.
Figure 8:
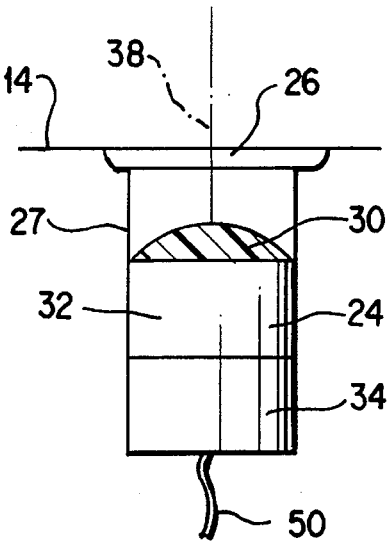
FIG. 8 is a diagrammatic cross-sectional view of the light beam generator of the improved golf club of the invention showing one light beam extending from one of three separate light beam generators.
Figure 6:
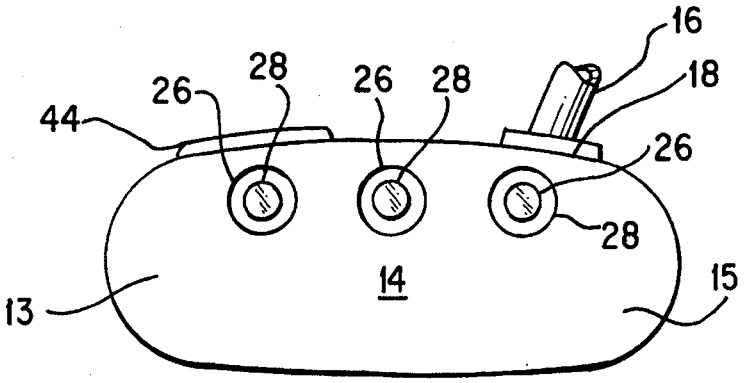
FIG. 6 is a front planar view of the improved golf club of the invention utalizing three light generators.
Figure 7:
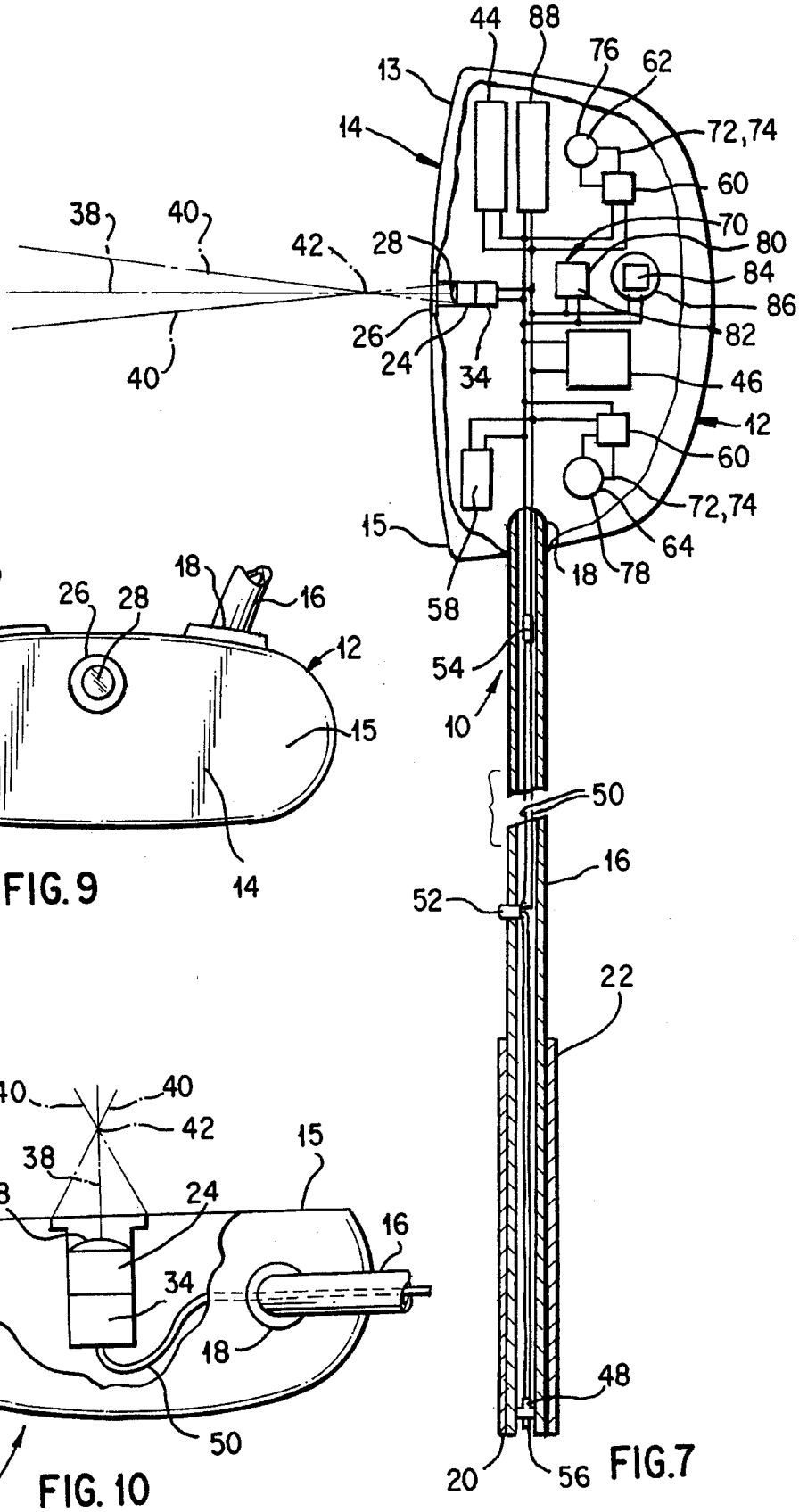
FIG. 7 is a view the improved golf club of the invention utalizing a single light generator to provide three light beams.
Figure 9:
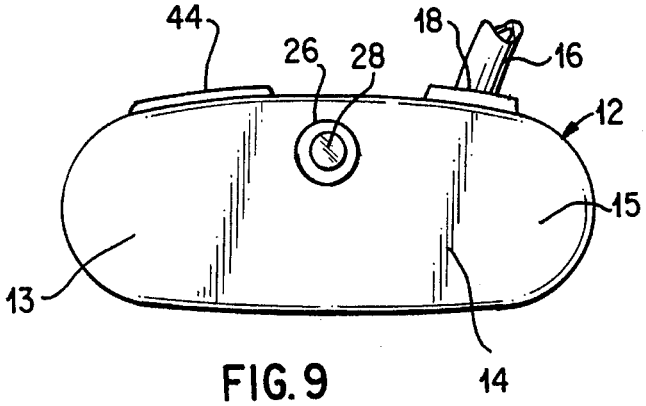
FIG. 9 is a fragmentary view of the golf club of the invention showing a single light generator used to create three light beams.
Figure 10:
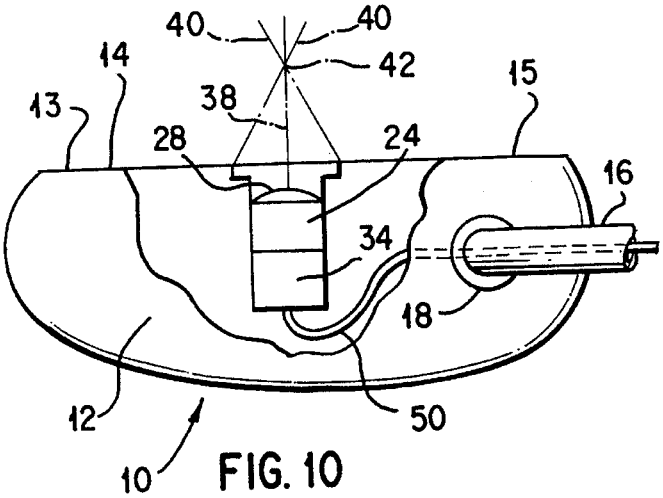
FIG. 10 is a top view in partial cross section of the golf club of FIG. 9.

Head 12 may be provided in various versions, including a first version, shown in FIGS. 3–6, and a second version shown in FIGS. 7–9. The sole difference between the version shown in FIGS. 3–6 and the version shown in FIGS. 7–9 is the use of three identical light generators in the version illustrated in FIGS. 3–6, and the use of a single compound light generator in the version shown in FIGS. 7–9. Each light generator 24 is preferably a laser diode 23.

Figure 4:
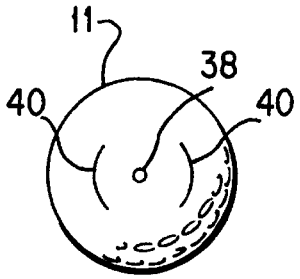
FIG. 4 is the golf club striking surface's view of a golf ball showing impingement of the light beams of the invention thereon.

Referring to FIGS. 1–4, the improved golf club 10 of the invention is shown to have three light generators 24, each of these light generators being in the club face 14 at the height of the center of the ball. The light generators 24 are spaced apart, there being a central light generator 24 and a light generator 24 on each side thereof. Each of the light generators 24 is in the configuration as shown in FIG. 5.

The golf club 10 shown may comprise a "mallet"-type putter, such as the one marketed by Ram Golf Corporation under the Zebra trademark. Since USGA rules require that a golf ball have a diameter of no less than 1.680 inches, and since most balls made have this or a slightly greater diameter, the center of the beams emanating from the light generators will be approximately 0.850 inches from the bottom edge of the club. The center beam is preferably located about midway between the toe and heel portions of the club.

The light generators 24 are mounted in proximity to the surface of the club face 14 and are preferably positioned behind a planar piece of transparent material 26, such as optical glass or plastic. The transparent material 26 is preferably inset into club head 12 such that the transparent material 26 is flush or slightly recessed within an aperture 27 in the club head 12.

Alternately, a transparent material 26 may be mounted substantially across the club face 14. The transparent material may be adapted to form a primary lens 28 in the path of the light generator 24 to focus the light beam 38 as desired in accordance with conventional laser technology. Preferably, one of the primary lenses 28 and the secondary lens 30 is selectively positioned in optical alignment within the aperture 27 in the club head 12 to adjust the focus of the light beam 38 in a manner known in the art.

Behind the secondary lens 30 is a laser diode 32 of conventional construction. The laser diode 32 is connected through the rear of the diode to the laser diode circuit board 34 by conductors 36.

Space may be provided between the secondary lens 30 and the light generator 24 so as to allow movement of the laser diode 32 toward and away from the lenses 28, 30 to provide the exact focus of the light beam emanating therefrom to the golfer's liking.

Figure 2:
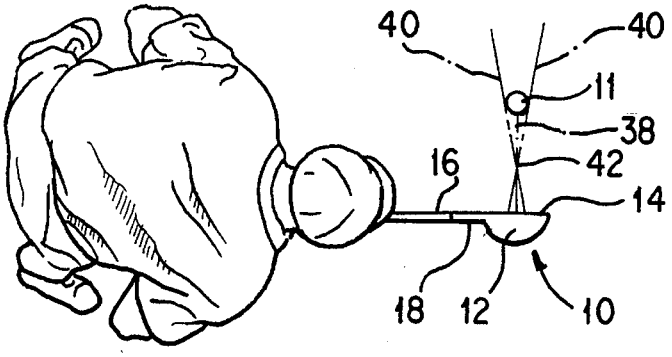
FIG. 2 is a top sectional view of a golfer holding the golf club of the invention while utilizing the improved alignment features thereof.

Each of the light generators 24 are also directed by their positioning in the head 12 to project a light beam 38, or 40, outwardly from the club head surface 14 as shown in FIGS. 1–3. In the embodiment shown in FIGS. 3–6, a central light generator 24 projects a light beam 38 substantially perpendicular to the club face 14. Separate light generators 24 on either side of the central light generator 24 each project an angular light beam 40 which is projected angular to the club face 14 so as to intersect the central light beam 38 at a point 42 remote from the club face 14. In specific embodiments of the golf club, point 42 is spaced from club head from about one-half inch to about 12 inches therefrom and may vary as to the club.

Each of these light beams 38 or 40 are visible to the golfer's eye as he aligns the ball and swings through the ball. Central light beam 38 is shaped to be circular in cross-section as shown in FIG. 4. The angular light beams 40 are preferably shaped to project a crescent or arc shaped beam 40. Light beams 38 and 40 are shown as projected onto a golf ball 11, in FIG. 4.

The crescent shaped light beams 40 preferably have a radius substantially equal to the golf ball 11. When the golfer is poised in a hitting stance over the golf ball 11, as shown in FIGS. 1 and 2, the central light beam 38 is projected at the center of the ball or down the fairway or across the green (in the case of a putter) as shown in FIGS. 1 and 2. The crescent shaped light beams 40, when the club head 12 addresses the ball 11, converge to intersect at a point 42 and to diverge beyond the point 42 as shown in FIGS. 1 and 2.

Light beam 38, when used with a putter, may be focused so as to generate a visual laser light line across the green toward the hole. The laser beam 38, in a specific embodiment, may be combined with a conventional distance meter (not shown) to give the golfer a measured distance between the golf club 10 and the cup, such that the golfer has the ability to know exactly how long a putt is ahead.

Inasmuch as the center of the golf ball 11 cannot be accurately determined, but only visually determined, the converging/diverging beams 40 allow the golfer to more accurately determine the center of the ball as he swings by visually maintaining beams 40 equally distanced from the ball 11 throughout the swing thereby aligning the club 12 and the ball 11 during the swing.

Figure 11:
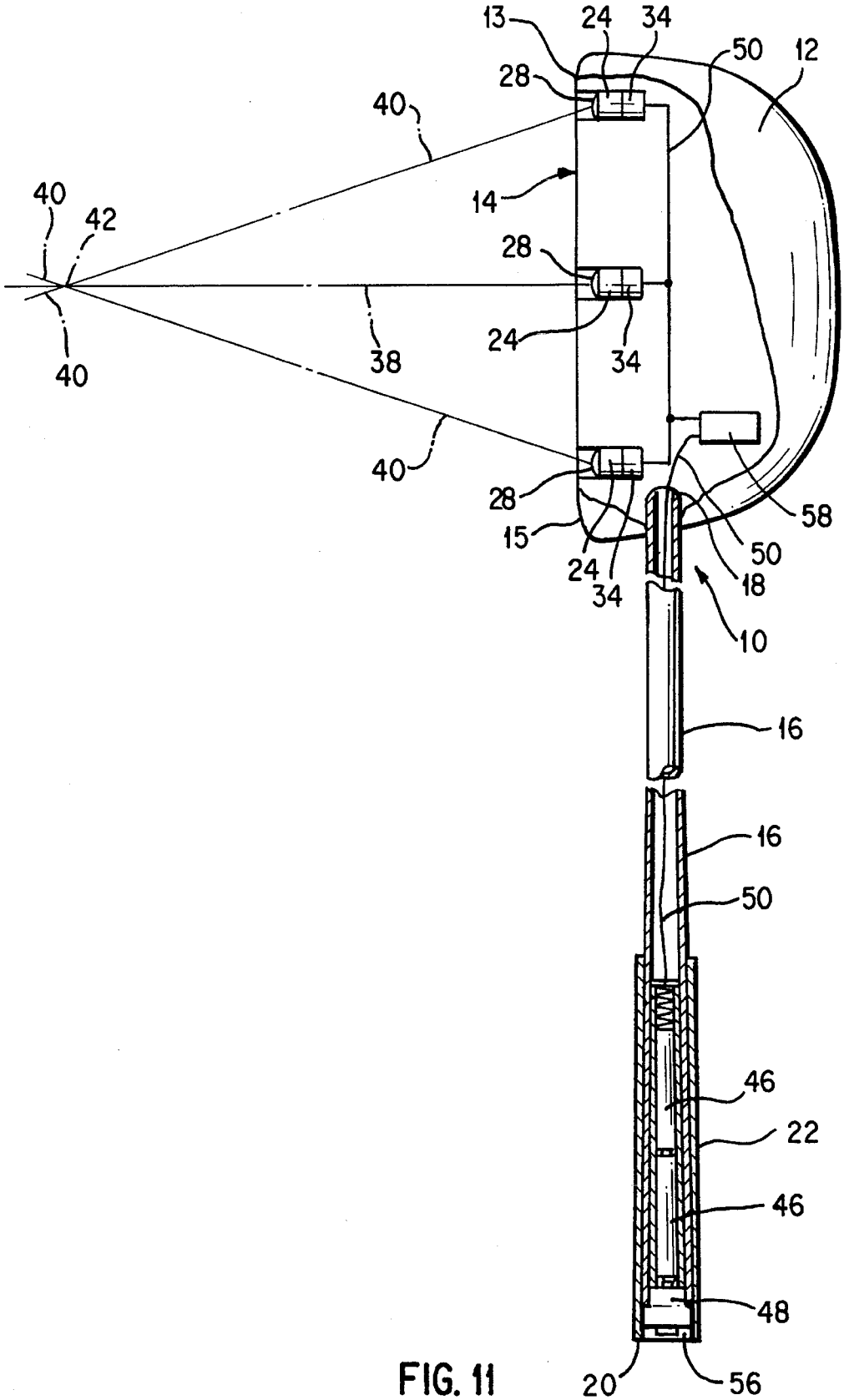
FIG. 11 is a view of the improved golf club of the invention utalizing three separate light generators, wherein when the switch is on, the positive voltage passes from the batteries through the shaft of the golf club, and a single negative wire connects to the light generator.

Each of the light generators 24 are connected to an energy source 46 located within club head 12 and a switch means 48 located at the grip handle 22 of shaft 16 by leads 50 emanating from the circuit board 34 and traveling up inside the golf shaft 16. Preferably, the shaft 16 is used as a positive energy conductor, so that only one negative wire 50 extends within the shaft 16, as best shown in FIG. 3 and FIG. 11.

Connected in parallel with the switch means 48 is preferably an LED 52 which is illuminated whenever the circuit is on. The switch means 48 may be any known type of switch 48, which is positioned to selectively connect and disconnect the energy source 46 from the circuit board 34, and all of the other operative circuits within the club head 12.

One such switch means 48 is a mercury switch 54, which is positioned to shut off the energy source 46 from the circuit board 34, whenever the club 10 is inverted, such as when the golf club 10 is laid upon the ground, or stored inverted in a golf bag (not shown).

Switch means 48 may be any type of conventional on/off switch, such as a push switch, a toggle switch, a slide switch, or any other switch means 48 known in the art. In a specific embodiment, switch means 48 is a push-button switch 56 mounted coaxially on the shaft and recessed from shaft end 20. Switch 48 may be accessed through end opening 56 by the user's finger, or by a golf tee or like instrument to selectively turn the electronics of the club on and off as desired. By recessing the switch means 48, the switch means 48 will not be inadvertently activated when the club is placed in a golf bag or when the shaft end 20 of the grip 22 is otherwise impacted against a foreign object.

In one specific embodiment, a switch means 48 has a clock means 58 connected to the switch means 48 so that all of the circuitry of the club 10 is turned off after a preset time period has elapsed.

Other types of switch means 48 can obviously be used in other specific embodiments. Those that are particularly useful are switch means 48 which are positioned near the thumb position of a golfer when gripping the club grip handle 22, and include pressure sensitive switches 60 such that the grip handle 22 of the club 10 may be squeezed by the golfer to selectively turn the circuitry of the club 10 on and off.

Although described with particular reference to a putter, the invention has utility with respect to other golf clubs. For example, the laser feature may be used when addressing the ball to give the golfer assurance that the club face is positioned with the "sweet spot" of the club aligned with the center of the ball.

A first contact indicator 62 may be positioned adjacent the toe 13 of the club 10, and a second contact indicator 64 may be positioned near the heel 15 of the club 10. For the most part, contact indicators 62, 64 are identical. Each includes an LED 66 connected to a contact circuit board 68. Contact circuit board 68 preferably includes a circuit which provides voltage to illuminate the LED 66, a contact switch means 72 which illuminates the LED 66 when the contact switch means 72 is actuated, and a sound maker 70 which is turned on for a short duration, such as ten seconds or less to indicate an audible sound whenever the LED 62 is turned on. The contact switch means 72 of the circuit 68 is normally open. The contact switch means 72 of the contact circuit closes upon impact of the club with a golf ball 11 or any other object to illuminate the LED 62 and to actuate the sound maker 70 to emit for a selected time (in one embodiment, from one to ten seconds) an audible sound.

Both LEDs 76, 78 and the contact switch means 72 are interconnected to the energy source 46 by leads 50 emanating from the circuit board 68. As will be mentioned hereinafter, the contact switch means 72 may be a contact mercury switch 74 which is positioned to close upon impact, illuminating the LEDs 76, 78 and causing an audible sound from the respective sound makers 80, 82.

In a specific embodiment, LEDs 66 are preferably red 76 and green 78 and individual sound makers 70, 71 each have a different pitch so as to both visually and audibly indicate which contact circuit board 68 is activated upon impact. For example, the toe 13 of the club face 14 may have a red LED 76 and a low pitched sound maker 80. The heel 15 of the club face 14 may have a green LED 78 and a high pitched sound maker 82.

As will be mentioned hereinafter, the first and second indicators 62, 64 may be adapted to indicate to the golfer whether the ball first contacts the toe or the heel of the club and is useful to the golfer to correct errors in a golf swing through practice.

When applying the invention to clubs other than putters, an inertial force meter 84 may be positioned within club head 12 to measure the force of the swing. The inertial force meter 84 is provided with an impact circuit board 86 and a digital impact readout means 44 positioned on the top of the club head 12 as shown in FIGS. 6 and 9. The digital readout means 44 is connected to the impact circuit board 86 by suitable leads 50, and the impact circuit board 86 is connected to energy source 46 by leads 50 as are all of the other components of the improved golf club 10 of the invention.

In a specific embodiment of this invention, the energy source 46 is a six-volt DC battery, however one of average skill in this art may adapt this invention for use with other voltages, and such other voltages are intended to fall within the scope of this disclosure, and the claims disclosed herein.

In this and other specific embodiments, the laser diode 32 is preferably a Toshiba TOLD9321 or its equivalent, or any other laser diode capable of producing a satisfactory light beam. When Toshiba TOLD9321 laser diodes are used, it has been found that the six-volt battery has a life of over 30 hours of continuous use.

In a specific embodiment, the circuit boards are interchangeable thereby allowing a training club to be converted to a practice club as desired.

As shown in FIG. 5, FIG. 7 and FIG. 9, a single light generator 24 may be used to produce three light beams 38, 40. In this embodiment, lens 28 is of a nature such that a central beam 38 as well as opposing crescent-shaped beams 40 are directed onto the ball surface. Accordingly, the functions described with reference to the embodiment of FIGS. 1–6 can be achieved.

Three beams of light from one laser source may be generated by compressing the light in a collimating barrel and reflecting the outer beams of light to the outside area of the lens, in an opposing crescent shaped pattern. The central light beam 38 and opposing crescent shaped light beams 40 pass through the lens and onto the target. The length and diameter of the collimating barrel in conjunction with the lens determines the focal point, and the pattern of light displayed.

In operation, the improved golf club 10 of the invention may be utilized to strike a golf ball 11 as any other golf club now available and in use. However, the improved golf club 10 of the invention conveys to the golfer using the club 10 a variety of information never heretofore available to the golfer, enabling the golfer to adjust the swing in ways never before thought possible.

With respect to a putter, as the light beams 38, 40 project a light beam from the club face 14 of the golf club 10, the two outer light beams 40 move to the outside of the golf ball when the club is moved away from the ball 11, while the center beam 38 remains centered. As the club is moved towards the ball, as in a striking or putting motion, the two outer beams converge toward the center giving a 3-D visual picture of how straight and level the golfer's swing is and whether or not the swing is an inside-out or outside-in swing or if the golf club 10 is twisting in the golfer's hand during the stroke.

As the center of the ball 11 can only visually be determined and not very accurately, the outer beams 40 provide a 3-D visual picture of how straight and level the swing actually is in reference to the golf club face 14. It is also contemplated that the structure of FIG. 8 may be employed alone whereby only a single beam 38 is projected onto the ball surface. This arrangement still provides an excellent training method for a golfer, particularly when putting, since the single beam will still project onto the back of a ball at the center thereof when the putter is positioned properly at address. The golfer can then learn to control the back and forward stroke movements to keep the light spot in this location at all times. This will insure development of a stroke wherein the putter is square to the target line at all times.

In the embodiments involving other clubs, in which the inertial force meter 84 is provided visually to the golfer by the digital readout means 44, the alignment of the club 10 to the ball 11, the alignment of the swing to the preferred trajectory of the club 10, and the strength of the swing are all related to the golfer for appropriate adjustments in his swing.

Once the swing is accomplished, the improved golf club 10 of the invention conveys to the golfer whether or not the ball is hit in the center or "sweet spot" of the club face, or adjacent the toe 13 or adjacent the heel 15. This is done by the contact switch means 72 and the first and second contact indicators 62, 64. If the ball strikes the club face 14 adjacent the toe 13, the red LED 76 of the first contact indicator 62 will be illuminated. If the golf ball is hit adjacent the heel of the club, the green LED 78 of the impact device 60 will be illuminated. Where the golf ball is hit directly in the center of the club, both the red LED 76 and the green LED 78 will be illuminated.

Of course it is within the scope of one of average skill in this art to substitute alternate LED colors, and such changes in color are intended to fall within the scope of this disclosure, and the following claims.

Whenever either LED 76 or LED 78 is illuminated, the respective sound maker 80, 82 will preferably emit a buzzing noise of either a low pitch or a high pitch audibly indicating the same impact location on the club face 14 as the LEDs 76, 78 visually indicate. Where the golf ball is hit directly on the sweet spot of the club, both the low pitch and the high pitch will be simultaneously actuated.

By the inertial force meter 84, and the LEDs 76, 78 all of the information regarding the strength of the swing, and the impact alignment are visually and/or audibly conveyed to the golfer. By the light beams 38, 40, the golfer can visually determine the alignment of the swing and the club face 14 to the ball 11. All of the information necessary for the golfer to correct the swing and to improve his swing and a means to perfect his swing is available to the golfer.

In a specific embodiment, the readout of the meter 72 and the illumination of the LEDs 62, 63 may be recorded on videotape so that all of the information can be discussed with a golf professional so as to allow the golfer to make appropriate adjustments during a training session.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A golf club comprising a shaft, said shaft having a head end and a shaft end, a club head secured to said shaft end, said club head having a club face hitting surface, a grip handle secured to the shaft end, a light generator and an energy source operatively connected to each other and mounted within said club to generate a plurality of light beams, said light beams emanating from said head hitting surface on opposite sides of a centrally located sweet spot, respectively, said beams converging to and intersecting an imaginary line extending from the center of said head surface generally perpendicular to said head surface, whereby said light beams are visually discernible by the golfer to align the club head with the ball to be struck during both the back stroke and the forward stroke of the golf club.

2. The golf club of claim 1 wherein said grip handle has a switch means operatively connected to said light generator and energy source, whereby said light generator may be turned on and off by actuating said switch means.

3. The golf club of claim 2 wherein said switch means is actuated by the position of said club, said switch means being in an off position when said club head is elevated above said grip, said switch means being in an on position when said club head is located beneath said grip.

4. The golf club of claim 3 wherein said switch means is a mercury switch.

5. The golf club of claim 2 wherein said switch means is actuated by squeezing said grip handle.

6. The golf club of claim 1 further comprising a timer means operatively connected to said energy source and light generator, said timer means turning said light generator off after the elapse of a set time period.

7. The golf club of claim 1 wherein an impact gravity meter is operatively connected between said light generator and said energy source, said impact gravity meter including means for registering the inertia of the golf swing and for being reset to zero between swings.

8. The golf club of claim 1 wherein said energy source is positioned within said club head and operatively connected by an electrical conductor extending between said switch and said light generator.

9. The golf club of claim 1 wherein said light generator is a laser.

10. The golf club of claim 9 wherein said light generator is positioned within said club head and operatively connected by an electrical conductor extending the length of said shaft between said light generator and said switch.

11. The golf club of claim 9 wherein said laser and said energy source are both positioned within said club head.

12. The golf club of claim 1, further comprising an indicator, said indicator being on when said light generator is on, and said indicator being off when said light generator is off.

13. The golf club of claim, 12 wherein said indicator is an LED.

14. A golf club comprising a shaft, said shaft having a head end and a shaft end, a club head secured to the head end of the shaft, said head having a club face hitting surface, a grip handle secured to the shaft end of the shaft, three light generators mounted in said head surface, one of said light generators being centrally located in said club face hitting surface and generating a light beam extending from said club head hitting surface generally perpendicular thereto at a height from the bottom of said club head generally equal to a radius of a conventional golf ball so as to project said light beam at the center of a golf ball when addressed by the club head, two remote light generators being located in said head surface spaced apart from said centrally located light generator on opposite sides thereof, respectively, at the same height from the bottom of said club head as said centrally located light generator, said remote light generators each generating a light beam angularly disposed to said hitting surface and intersecting said light beam from said centrally located light generator at a point remote from said club head hitting surface, whereby said light beams are visually discernible by the golfer during both the back swing and the forward swing to assist the golfer in aligning the club head with the ball to be struck.

15. The golf club of claim 14 wherein each light generator includes a lens system mounted in an aperture in the club head, a laser diode mounted in said club head behind said lens system, a laser diode circuit board mounted in said club head and operatively connected to said laser diode, and a focus mechanism mounted between said lens system and said laser diode for focusing said laser.

16. The golf club of claim 14 further comprising contact indicators adjacent the toe and the heel of said club head, respectively, said contact indicators each having an impact switch connected thereto and an indicator which is activated upon the closing of said switch, said switch being closed upon impact by said club head toe and foot, respectively, with a golf ball.

17. The golf club of claim 14 further comprising a force meter, said force meter being operatively connected to said energy source to measure the inertial force of said club head when swung, a readout device secured to said club head, said gravity meter being operatively connected to said readout device, whereby the inertial force of said club head during a swing is recorded on said force meter and displayed upon said readout device.

18. The golf club of claim 14, wherein said centrally located and remote light generators are combined into one light generator which generates said centrally located light beam and said remote light generators, said compound light generator being centrally located in said head hitting surface.

* * * * *